US009951505B2

(12) United States Patent
Bush

(10) Patent No.: US 9,951,505 B2
(45) Date of Patent: Apr. 24, 2018

(54) TOILET FIXTURE WITH DIRECTIONAL JET FLOW

(75) Inventor: Shawn D. Bush, Orlando, FL (US)

(73) Assignee: SDP IP Holdings, LLC, Orlando, FL (US)

( * ) Notice: Subject to any disclaimer, the term of this patent is extended or adjusted under 35 U.S.C. 154(b) by 847 days.

(21) Appl. No.: 13/297,753

(22) Filed: Nov. 16, 2011

(65) Prior Publication Data

US 2012/0144572 A1 Jun. 14, 2012

Related U.S. Application Data

(60) Provisional application No. 61/414,197, filed on Nov. 16, 2010.

(51) Int. Cl.
*E03D 11/08* (2006.01)

(52) U.S. Cl.
CPC ..... *E03D 11/08* (2013.01); *E03D 2201/30* (2013.01)

(58) Field of Classification Search
USPC .... 4/420–422, 425, 429, 368, 374, 344, 336
See application file for complete search history.

(56) References Cited

U.S. PATENT DOCUMENTS

| | | | | |
|---|---|---|---|---|
| 1,111,746 | A * | 9/1914 | Haas | 4/422 |
| 1,204,048 | A * | 11/1916 | Maddock | 4/425 |
| 2,158,362 | A * | 5/1939 | Groeniger | 4/425 |
| 3,591,869 | A * | 7/1971 | Manning | 4/425 |
| 3,736,922 | A * | 6/1973 | Schneider | 4/559 |
| D355,709 | S | 2/1995 | Osada | |
| D507,335 | S | 7/2005 | Gordon | |
| D603,943 | S | 11/2009 | Slothower et al. | |
| 7,661,153 | B2 | 2/2010 | Nakamura et al. | |
| 2007/0113331 | A1* | 5/2007 | Prokopenko et al. | 4/425 |
| 2011/0016623 | A1* | 1/2011 | Inglin et al. | 4/420 |

FOREIGN PATENT DOCUMENTS

| | | | |
|---|---|---|---|
| EP | 1134322 | A1 | 9/2001 |
| JP | 9-125502 | A | 5/1997 |
| JP | 2000-096689 | | 4/2000 |
| WO | 98/16696 | A | 4/1998 |

* cited by examiner

*Primary Examiner* — Erin Deery
(74) *Attorney, Agent, or Firm* — The Webb Law Firm

(57) ABSTRACT

A flush toilet is disclosed. The flush toilet includes a bowl having a waste receiving surface, a drainage channel having an inlet connected to a bottom portion of the bowl for discharging waste, and a throat adjacent the waste receiving surface and aligned with the drainage channel The flush toilet also includes a first water cleansing jet for supplying cleansing water onto the waste receiving surface. The first water cleansing jet is disposed within the throat. The flush toilet also includes a second water cleansing jet for supplying cleansing water onto the waste receiving surface. The second water cleansing jet is also disposed within the throat, with the second water cleansing jet being offset from the first water cleansing jet.

10 Claims, 3 Drawing Sheets

TOILET FIXTURE WITH DIRECTIONAL JET FLOW

CROSS-REFERENCE TO RELATED APPLICATION

The present application claims priority to U.S. Provisional Patent Application No. 61/414,197, filed Nov. 16, 2010, entitled "Toilet Fixture with Directional Jet Flow", the entire disclosure of which is herein incorporated by reference.

BACKGROUND OF THE INVENTION

Field of the Invention

The present invention relates generally to flush toilets and, more particularly, relates to flush toilets that utilize jets to emulsify and discharge waste.

Description of Related Art

Conventional flush toilets typically include a rim disposed at an upper edge portion of a bowl. The interior of the rim is often used as a water channel and the undersurface of the rim is formed with holes or slits for discharging cleansing water into the bowl and onto the waste receiving surface. Waste or other dirty matter often adheres to the undersurface of the rim as the cleansing water vortex does not typically reach the rim of the bowl.

Other conventional flush toilets include a single water spout provided at the rear of the bowl for providing jetted cleansing water from a region between the rim and the waste receiving surface. In these configurations, cleansing water is jetted from the water spout to form a vortex that carries the cleansing water over the waste receiving surface. In order to provide a sufficient volume of cleansing water to cover the waste receiving surface, the water spout typically includes a large diameter entrance into the bowl of the toilet. This results in significant drawbacks, as the large diameter entrance does not provide a sufficiently high water discharge pressure to form a water vortex in the bowl capable of fully removing waste from the waste receiving platform. A flush toilet utilizing a single water spout to jet cleansing water into the tank unavoidably experiences a decline in waterhead pressure during the supply of water from the tank of the toilet as the amount of water in the tank decreases as the flushing proceeds. When the waterhead pressure is increased to provide a vortex sufficient to cleanse the waste from the bowl, the amount of water jetted from the single spout increases to the point that the cleansing water is likely to spew out of the bowl. In addition, the single water spout toilet is likely to provide insufficient cleansing during the final stages of flushing as the water vortex does not sufficiently reach the outer portions of the bowl.

Accordingly, a need remains for a toilet design that eliminates the need for providing cleansing water holes within the rim of the bowl and also provides sufficient waterhead pressure to the waste receiving surface while maintaining the cleansing water within the bowl during a flush.

SUMMARY OF THE INVENTION

It is, therefore, an object of the present invention to provide a flush toilet that overcomes the deficiencies of the prior art.

In accordance with an object of the present invention, a flush toilet includes a bowl having a waste receiving surface, a drainage channel having an inlet connected with a bottom portion of the bowl for discharging waste, and a throat adjacent the waste receiving surface and aligned with the drainage channel. The flush toilet also includes a first water cleansing jet for supplying cleansing water onto the waste receiving surface, with the first water cleansing jet disposed within the throat. The flush toilet further includes a second water cleansing jet for supplying cleansing water onto the waste receiving surface, with the second water cleansing jet disposed within the throat, and wherein the second water cleansing jet is offset from the first water cleansing jet.

The flush toilet may include a first water cleansing jet and a second water cleansing jet which assists in the formation of a water vortex in the bowl. The flush toilet may also include a first water cleansing jet and a second water cleansing jet that are directed to expel cleansing water toward a common focal point.

The flush toilet may also include a first water cleansing jet adapted to expel cleansing water at a first velocity and a second water cleansing jet adapted to expel cleansing water at a second velocity, with the second velocity being greater than the first velocity.

The flush toilet may optionally include a first water cleansing jet having an outlet diameter of from about ⅜ inches to about ¾ inches, and a second water cleansing jet having an outlet diameter of from about ⅜ inches to about ¾ inches. The first water cleansing jet and the second water cleansing jet may also be directed to expel cleansing water toward the drainage channel.

In certain configurations, the flush toilet may also include a first water cleansing jet and a second water cleansing jet that are adapted to expel cleansing water in an upwardly angled direction along a portion of the drainage channel.

In accordance with another embodiment of the present invention, a flush toilet includes a bowl having a waste receiving surface, and a drainage channel having an inlet connected with a bottom portion of the bowl for discharging waste. The flush toilet also includes a throat adjacent the waste receiving surface and aligned with the drainage channel, and a plurality of water cleansing jets for supplying cleansing water onto the waste receiving surface, disposed within the throat and aligned with respect to a common focal point.

The plurality of water cleansing jets may be offset with respect to each other. In certain configurations, the plurality of water cleansing jets assists in the formation of a water vortex in the bowl. The plurality of water cleansing jets may include a first water cleansing jet adapted to expel cleansing water at a first velocity, and a second water cleansing jet adapted to expel cleansing water at a second velocity, with the second velocity being greater than the first velocity.

The plurality of water cleansing jets may have an outlet diameter of from about ⅜ inches to about ¾ inches. The plurality of water cleansing jets may also be directed to expel cleansing water toward a drainage channel. In another configuration, the plurality of water cleansing jets is adapted to expel cleansing water in an upwardly angled direction along a portion of a drainage channel.

In accordance with yet another embodiment of the present invention, a flush toilet includes a bowl having a waste receiving surface, and a drainage channel having an inlet connected with a bottom portion of the bowl for discharging waste. The flush toilet also includes a throat adjacent the waste receiving surface and aligned with the drainage channel, and means for directing cleansing water onto the waste receiving surface from a plurality of directions within the throat.

The means for directing cleansing water may assist in the formation of a water vortex in the bowl. hi another configuration, the means for directing cleansing water direct cleansing water toward a common focal point. The means for directing cleansing water may expel cleansing water toward the drainage channel. In another configuration, the means for directing cleansing water may expel cleansing water in an upwardly angled direction along a portion of the drainage channel The present invention, both as to its construction and its method of operation, together with the additional objects and advantages thereof, will best be understood from the following description of exemplary embodiments when read in connection with the accompanying drawings.

DESCRIPTION OF THE PREFERRED EMBODIMENTS

Figure 1:
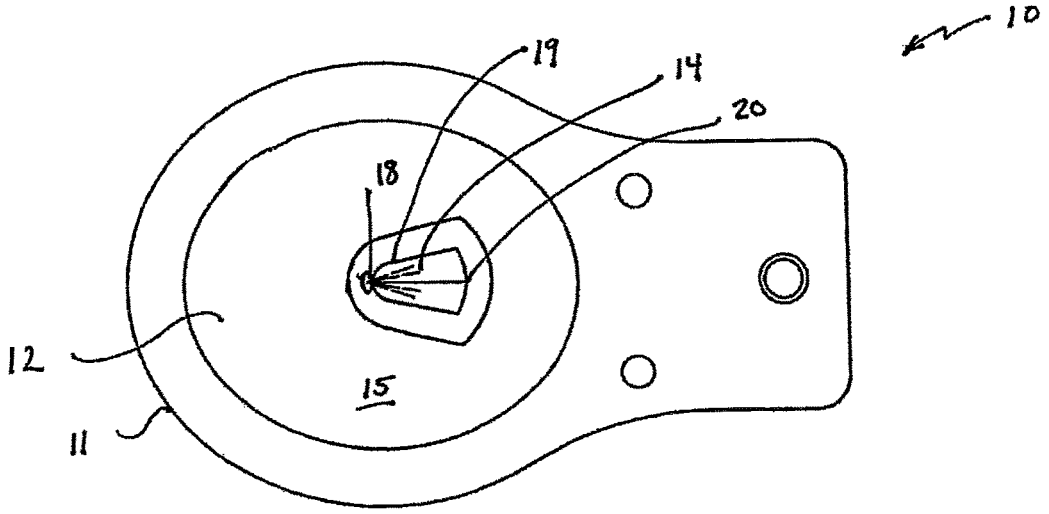
Fig. 1 Prior Art
FIG. 1 is a schematic top view of a prior art flush toilet having a single water cleansing jet.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
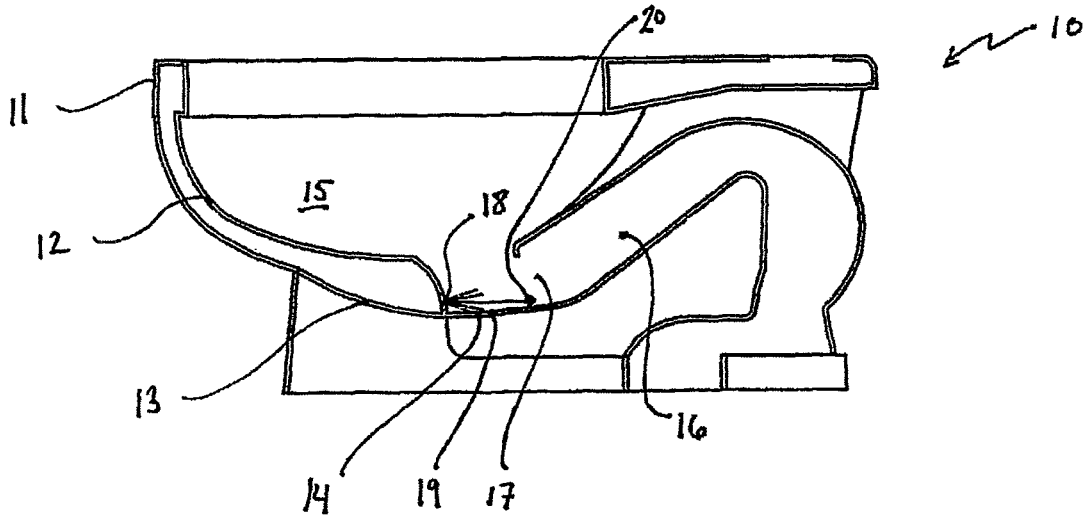
FIG. 2 PRIOR ART
FIG. 2 is a schematic front view of the prior art flush toilet of FIG. 1.

As shown in FIGS. 1-2, a conventional flush toilet 10 includes a bowl 12 having an upper rim 11 and a bottom portion 13. The interior 15 of the bowl includes a waste receiving surface 14 adapted to receive waste thereon. A conventional drainage channel 16 is shown adapted for providing an outlet for the waste deposited on the waste receiving surface 14 when cleansing water is applied thereto. An inlet 17 of the drainage channel 16 is disposed adjacent the waste receiving surface 14 and is adapted to allow passage of waste therethrough. A single water cleansing jet 18 is positioned within a throat 19 of the bowl 12 adjacent the waste receiving surface 14.

During a flush sequence of the flush toilet of FIGS. 1-2, pressurized cleansing water is directed through the single water cleansing jet 18 toward the waste receiving surface 14. The water cleansing jet of the flush toilet shown in FIGS. 1-2 has an internal diameter of from about ¾ inches to about 1 inch. As shown in FIG. 2, the pressurized cleansing water is linearly directed toward the drainage channel 16 at a contact point 20 of an interior wall portion of the drainage channel 16. This typically results in pressurized cleansing water and waste materials being spewed from the bowl 12 as a result of the impact of the pressurized cleansing water and waste at the contact point 20 of the interior wall portion of the drainage channel 16.

Figure 3:
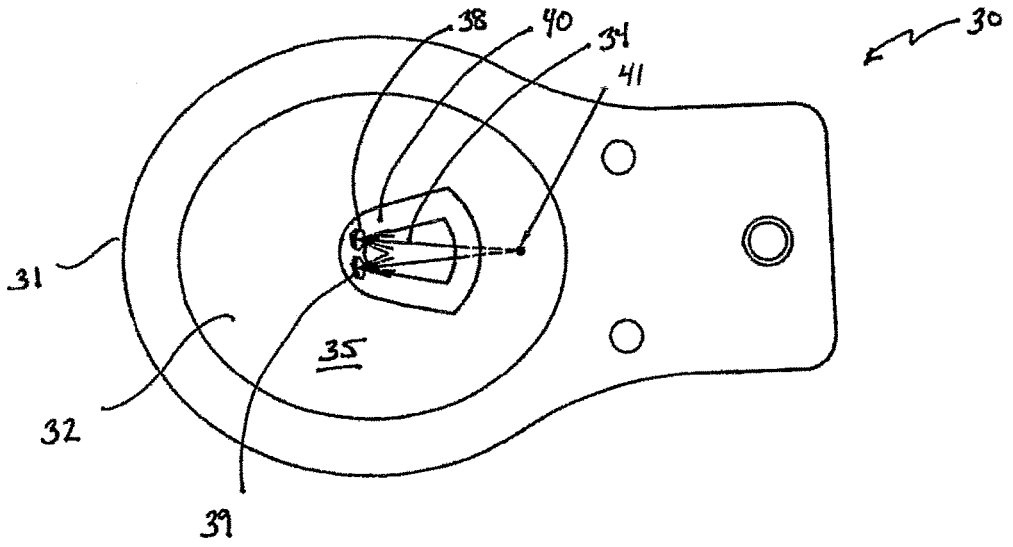
FIG. 3 is a schematic top view of a flush toilet having dual water cleansing jets in accordance with an embodiment of the present invention.
Figure 4:
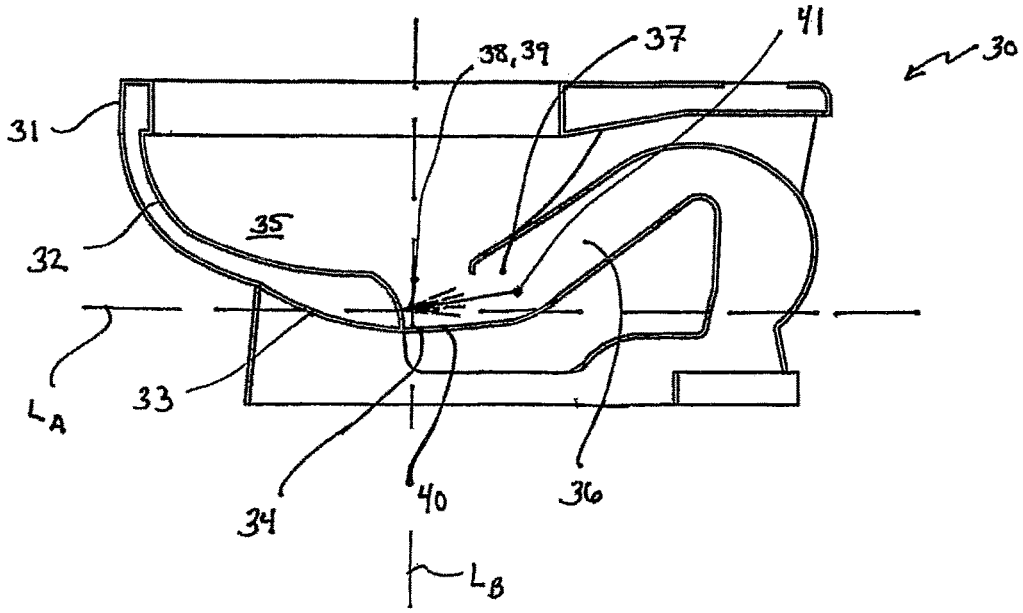
FIG. 4 is a schematic front view of the flush toilet of FIG. 3 in accordance with an embodiment of the present invention.

Referring to a flush toilet 30 of the present invention, as shown in FIGS. 3-4, the flush toilet 30 includes a bowl 32 having an upper rim 31 and a bottom portion 33. The interior 35 of the bowl 32 includes a substantially horizontal waste receiving surface 34 adapted to receive waste thereon. A drainage channel 36 is shown adapted for providing an inlet 37 for the waste deposited on the waste receiving surface 34 when cleansing water is applied thereto. The inlet 37 of the drainage channel 36 is disposed adjacent the waste receiving surface 34 and connected with the bottom portion 33 of the bowl 32, and is adapted to allow passage of waste therethrough.

A first water cleansing jet 38 for supplying cleansing water onto the waste receiving surface 34 is disposed within a throat 40 of the flush toilet 30. The throat 40 may be positioned adjacent the waste receiving surface 34 and may be aligned with the drainage channel 36. The throat 40 is substantially vertical such that the horizontal waste receiving surface 34 is at an approximately 90° angle to the throat 40. A second water cleansing jet 39, also for supplying cleansing water onto the waste receiving surface 34, is also disposed within the throat 40 of the flush toilet 30. In certain configurations, the first water cleansing jet 38 may be offset from the second water cleansing jet 39 such that the first water cleansing jet 38 and the second water cleansing jet 39 are spaced apart but aligned along the same lateral axis $L_A$. In another configuration, the first water cleansing jet 38 may be offset from the second water cleansing jet 39 such that the first water cleansing jet 38 and the second water cleansing jet 39 are spaced apart but aligned along the same longitudinal axis $L_B$. In yet another configuration, the first water cleansing jet 38 may be offset from the second water cleansing jet 39 such that the first water cleansing jet 38 and the second water cleansing jet 39 are diagonally spaced apart from each other.

In one configuration, the first water cleansing jet 38 and the second water cleansing jet 39 may have an internal diameter of from about ⅜ inches to about ¾ inches. In yet another embodiment, the internal diameter of the first water cleansing jet 38 and the second water cleansing jet 39 is less than the internal diameter of a single water cleansing jet 18, as shown in FIGS. 1-2. In this configuration, the first water cleansing jet 38 and the second water cleansing jet 39 direct the cleansing water into the bowl at a force that is about 40% greater than the force of a single water cleansing jet configuration. Accordingly, the combined force of the pressurized water entering the bowl 32 through the first water cleansing jet 38 and the second water cleansing jet 39 is greater than the force of the pressurized water entering the conventional bowl 12 though a single water cleansing jet 18, as described with reference to FIGS. 1-2, however, due to the diffuse entrance of the cleansing water into the bowl through a plurality of water cleansing jets, 38, 39, the water and waste are substantially restrained within the bowl 32. In another embodiment, the first water cleansing jet 38 is adapted to expel cleansing water at a first velocity and the second water cleansing jet 39 is adapted to expel cleansing water at a second velocity, with the second velocity being greater than the first velocity.

As shown in FIG. 4, the pressurized cleansing water of the flush toilet of the present invention, as shown in FIGS. 3-4, is angularly directed from both the first water cleansing jet 38 and the second water cleansing jet 39 toward the drainage channel 36 at a common focal point 41 disposed within the interior of the drainage channel 36. In one embodiment, both the first water cleansing jet 38 and the second water cleansing jet 39 are aligned with respect to the common focal point 41. In this configuration, both the first water cleansing jet 38 and the second water cleansing jet 39 may be upwardly angled to direct cleansing water along a portion of the drainage channel 36. This, in combination with the diffuse entry of the cleansing water into the bowl 32 through the first water cleansing jet 38 and the second water cleansing jet 39, typically results in pressurized cleansing water and waste materials being retained within the bowl 32. Rather than having the pressurized water and waste contact the contact point 20 of the interior wall portion of the drainage channel 16, shown in FIG. 2, the pressurized water and waste are directed through the interior of the drainage channel 36.

In addition, the first water cleansing jet 38 and the second water cleansing jet 39 may act together to better emulsify the waste present on the waste receiving surface 34 by providing pressurized cleansing water from two targeted locations. In one configuration, the first water cleansing jet 38, the second water cleansing jet 39, and the waste receiving surface 34 may form a triangular relation, thereby allowing both jets 38, 39 to emulsify the waste from different directions.

In certain configurations, the first water cleansing jet 38 and the second water cleansing jet 39 are adapted to assist in the formation of a water vortex in the bowl 32. In this embodiment, the first water cleansing jet 38 may be adapted to introduce pressurized water into the bowl 32 by imparting an angular acceleration thereto. The second water cleansing jet 39 may be oriented to introduce pressurized water into the bowl 32 at a location and at an angular acceleration that accelerates the pressurized water introduced into the bowl 32 from the first water cleansing jet 38. This accelerated vortex may further assist in the emulsification of the waste present on the waste receiving surface 34, and may also assist in the passage of the waste through the downstream conventional piping system, not shown.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A flush toilet, comprising: a bowl having a waste receiving surface;

a drainage channel having an inlet connected with a bottom portion of the bowl for discharging waste;

a throat adjacent the waste receiving surface and aligned with the drainage channel;

a first water cleansing jet for supplying cleansing water onto the waste receiving surface, the first water cleansing jet disposed within the throat; and a second water cleansing jet for supplying cleansing water onto the waste receiving surface, the second water cleansing jet disposed within the throat, wherein the second water cleansing jet is offset from the first water cleansing jet, wherein the waste receiving surface is substantially horizontal and the throat is substantially vertical, wherein the first water cleansing jet and the second water cleansing jet assist in the formation of a water vortex in the bowl, wherein the first water cleansing jet and the second water cleansing jet are directed to expel cleansing water toward a common focal point, and wherein the first water cleansing jet is adapted to expel cleansing water at a first velocity and the second water cleansing jet is adapted to expel cleansing water at a second velocity, the second velocity being greater than the first velocity.

2. The flush toilet of claim 1, wherein the first water cleansing jet has an outlet diameter of from about ⅜ inches to about ¾ inches, and the second water cleansing jet has an outlet diameter of from about ⅜ inches to about ¾ inches.

3. The flush toilet of claim 1, wherein the first water cleansing jet and the second water cleansing jet are directed to expel cleansing water toward the drainage channel.

4. The flush toilet of claim 1, wherein the first water cleansing jet and the second water cleansing jet are adapted to expel cleansing water in an upwardly angled direction along a portion of the drainage channel.

5. A flush toilet, comprising: a bowl having a waste receiving surface;

a drainage channel having an inlet connected with a bottom portion of the bowl for discharging waste;

a throat adjacent the waste receiving surface and aligned with the drainage channel;

a plurality of water cleansing jets for supplying cleansing water onto the waste receiving surface, disposed within the throat and aligned with respect to a common focal point, wherein the plurality of water cleansing jets comprises a first water cleansing jet adapted to expel cleansing water at a first velocity and a second water cleansing jet adapted to expel cleansing water at a second velocity, the second velocity being greater than the first velocity; and wherein the waste receiving surface is substantially horizontal and the throat is substantially vertical.

6. The flush toilet of claim 5, wherein the plurality of water cleansing jets are offset with respect to each other.

7. The flush toilet of claim 5, wherein the plurality of water cleansing jets assist in the formation of a water vortex in the bowl.

8. The flush toilet of claim 5, wherein the plurality of water cleansing jets has an outlet diameter of from about ⅜ inches to about ¾ inches.

9. The flush toilet of claim 5, wherein the plurality of water cleansing jets is directed to expel cleansing water toward the drainage channel.

10. The flush toilet of claim 5, wherein the plurality of water cleansing jets is adapted to expel cleansing water in an upwardly angled direction along a portion of the drainage channel.

* * * * *